United States Patent [19]

Faulstich

[11] 4,384,447

[45] * May 24, 1983

[54] WIRE STRANDING APPARATUS

[75] Inventor: Gerhard H. Faulstich, Spartanburg, S.C.

[73] Assignee: International Wire Products Company, Wyckoff, N.J.

[ * ] Notice: The portion of the term of this patent subsequent to Dec. 1, 1998, has been disclaimed.

[21] Appl. No.: 336,370

[22] Filed: Dec. 31, 1981

[51] Int. Cl.[3] ..... D07B 3/12; D01H 7/86

[52] U.S. Cl. ..... 57/58.52; 57/58.63; 57/58.83

[58] Field of Search ..... 57/58.3, 58.32, 58.52–58.57, 57/58.72, 58.81, 58.83, 58.63

[56] References Cited

U.S. PATENT DOCUMENTS

| | | | |
|---|---|---|---|
| 1,516,900 | 11/1924 | Wright et al. | 57/58.81 X |
| 3,791,127 | 2/1974 | Wesson | 57/58.52 |
| 3,867,809 | 2/1975 | Holbrook | 57/58.52 |
| 4,072,003 | 2/1978 | Mino | 57/58.52 |
| 4,302,924 | 12/1981 | Faulstich | 57/58.52 |

FOREIGN PATENT DOCUMENTS

| | | | |
|---|---|---|---|
| 1085134 | 9/1967 | United Kingdom | 57/58.52 |

*Primary Examiner*—John Petrakes
*Attorney, Agent, or Firm*—William G. Rhines

[57] ABSTRACT

This invention relates to apparatus for stranding filaments, such as wire, and in one embodiment comprises a lightweight frame with low centripetal and friction force generating characteristics for mounting a spool containing a multiplicity of parallel-wound wires on a "floating" bed, and imparting twist to the wires prior to the finished strand being accumulated on a take-up reel, with the bed mounted at each end to the interior of a twisting frame by means of bearings such that the twisting frame may revolve about the stationary bed.

4 Claims, 13 Drawing Figures

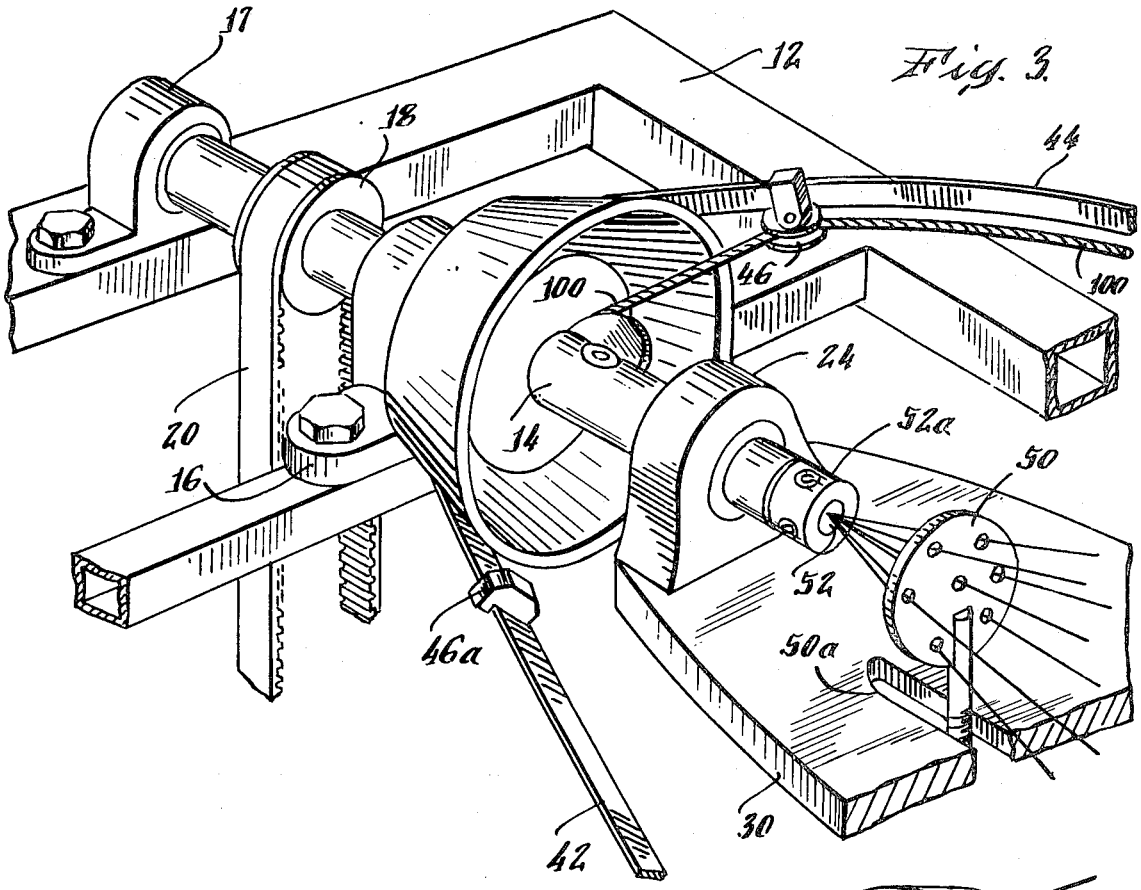
Fig. 3.
Fig. 4.
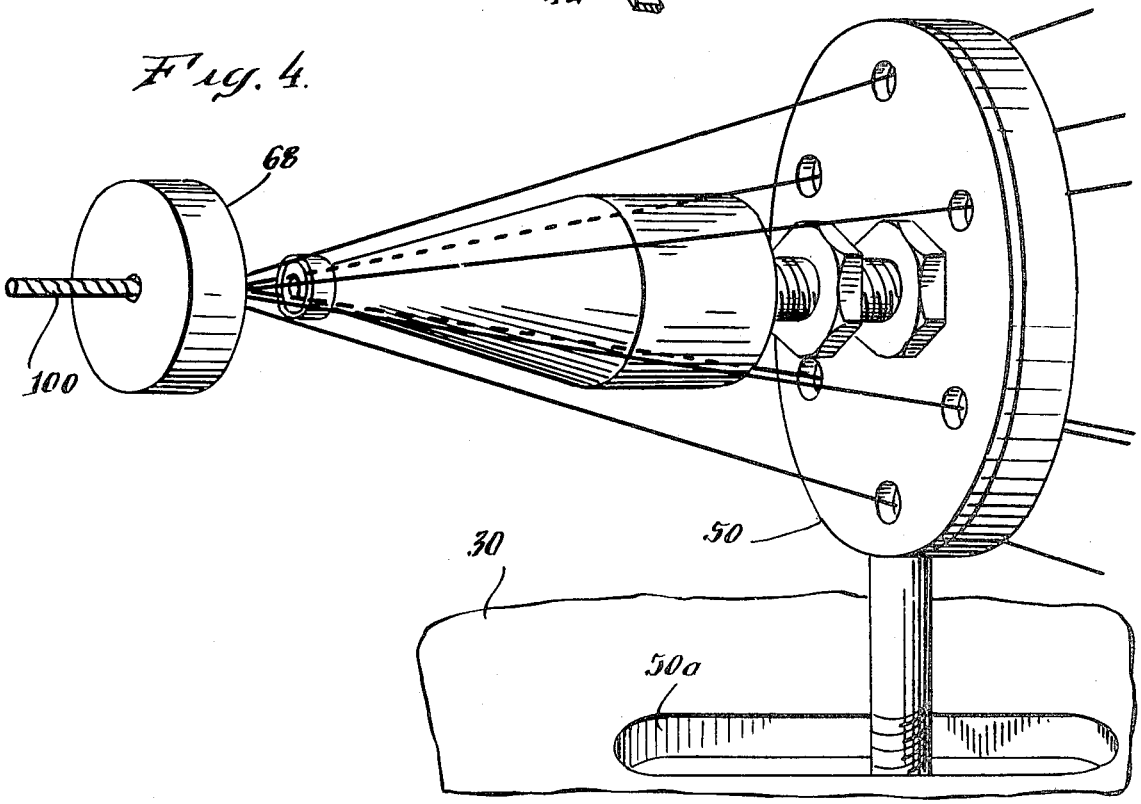

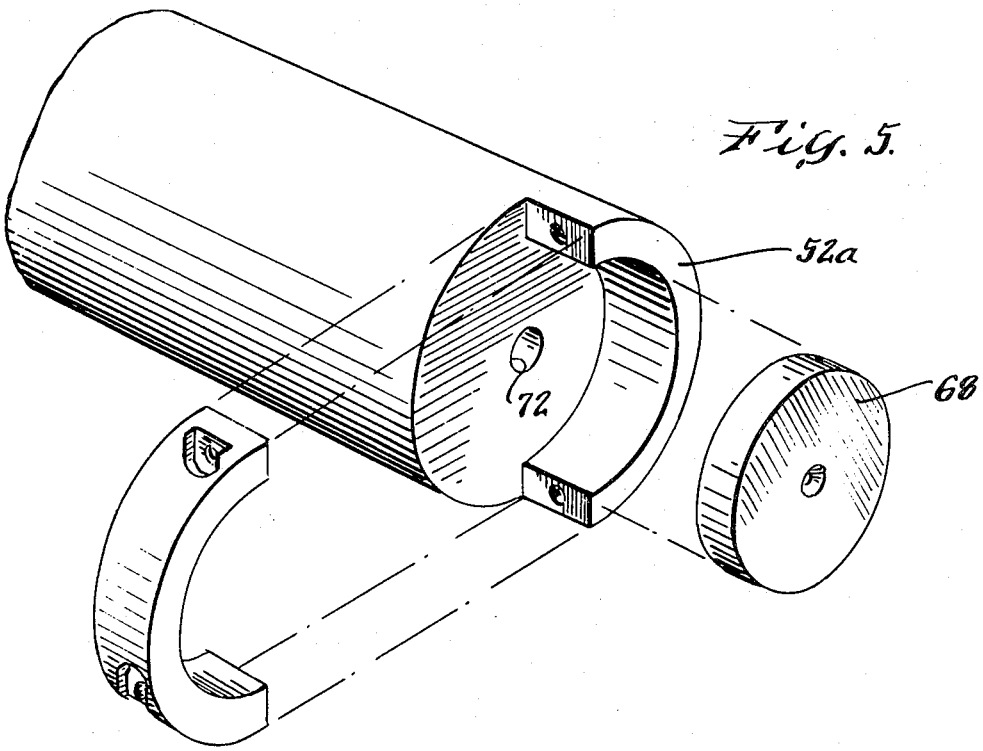
Fig. 5.
Fig. 6.
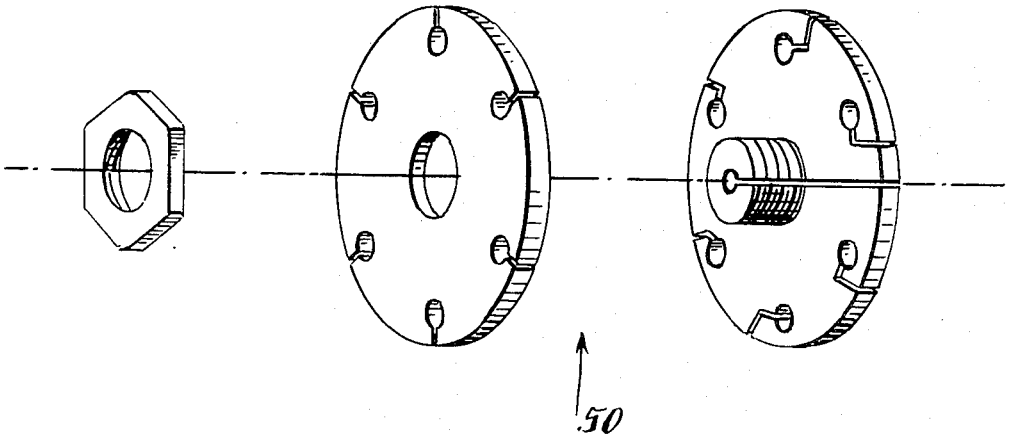

WIRE STRANDING APPARATUS

BACKGROUND OF THE INVENTION

A wide variety of machinery is available for stranding continuous filaments, for example, stranded metal wire of the type which subsequently is insulated for use in electrical installations. Such operations have been performed in the past on machines in which the spools of wire were rotated about a central core wire to produce a so-called concentric strand configuration. By a "concentric" strand is meant one wherein the strands of each successive layer surrounding the core wire rest side-by-side, and have some back-twist to reduce the tendency of the strand of wires to open up. The mechanical and dynamic problems inherent in such machines include relatively high centrifugal forces and high friction forces, which limit operating speeds and necessitate reinforced and complex structures. Additionally, the finished product tends to be difficult to control as to surface condition, and uniformity of size and weight. Such considerations have led to the use of other means to produce stranded wire. For example, so-called bunchers, particularly of the "reverse twist" type, have been modified to guide the constituent wires into the geometric configuration of a concentric strand, rather than the comparatively random configuration of a bunch strand. However, the products of such operations exhibit characteristics which are deemed undesirable in the industry. For example, insufficient back-twist in the individual strands to ensure dynamic retention of the constituent wires in place, and damage to the constituent wires caused by the dies that are used to effect closure of the wires and monitoring of the overall diameter of the finished strand, are objectionable results of such processes, and are among the reasons for the better alternative having been sought in other apparatus. The so-called "barrel strander" overcomes these objections. In such machines, a row of spools each containing a single continuous end of wire, all of which are single ended spools, or one or more of which may be a multi-ended, previously stranded continuum, are gimble-mounted on support bearings along the central axis of an apertured outer cylinder, so that the latter may revolve about them while they remain relatively stationary. The wires may then be paid off from the spools through pulleys arrayed on the inside of the cylinder, through a closure die to a take-up reel for the finished strand. However, in order to achieve the high barrel rotation speeds which are a necessary concomitant of the high production rates which are desired, it is necessary to minimize as far as possible the weight and diameter of the barrel, so that centrifugal forces will be minimized as well. Correspondingly, this presents engineering problems in accomodating spools of individual size such that comparatively long strands may be produced, and in mounting them in tandem down the length of the axis of the interior of the barrel. The result is that machinery of this type does not lend itself to the production of materials which are susceptible to deformation as a consequence of the resulting torsional and friction forces. This happens, for example, on finer strands made from malleable material such as copper, causing the quality, size, weight, surface, and electrical variations which result not to be up to standards desired by industry. Further, in the use of stranders of the barrel type, when an individual spool of wire runs out, it is an industry practice to connect the end of the wire on the spent spool to the beginning of the wire on a replacement spool. This is done by silver-soldering the two together or utilizing other connection means, which can be tedious and time-consuming to perform. The structural configuration, and size limitations of such machines render alternative procedures impractical.

In my previous patent application Ser. No. 96,140, filed Nov. 20, 1979 and now U.S. Pat. No. 4,302,924, I disclosed apparatus which overcomes many of the drawbacks of prior art devices, while, at the same time, is capable of producing products having commercially acceptable, and in some cases improved, characteristics. However, as a further improvement, I have found it desirable to find means to fulfill a number of additional objectives, including to further reduce the size and weight of such apparatus, to reduce the weight and force bearing requirements of the components of such apparatus, to increase the speed of such machines, to reduce or eliminate tension problems on the individual wires being stranded, to reduce the probability of individual wire breakage, to reduce the machine down-time due to such things as discontinuities in the length of wires as between spools, and to achieve other desired objectives.

Accordingly, it is an object of this invention to provide means to produce a configuration of continuous filaments, such as wires that will enable achievement of the foregoing objectives.

Another object of the present invention is to provide such means to minimize weight, diameter, resistivity, and surface variations in the production of articles made from comparatively deformable materials.

Still another object is to provide stranding means in which changeovers in direction and/or lay-length may be easily changed.

Another object is to produce such means which are easier to load than prior art strading machines.

Yet another object is to satisfy the foregoing objectives with means which have low weight and simple construction, to minimize centrifugal and other dynamic forces when the machine is in operation and to facilitate access to its various constituent parts for its operation and maintenance.

Still another object of this invention is to provide means for satisfying the foregoing objectives wherein the multiplicity of wire-ends being used may be changed simultaneously by changing a single spool.

SUMMARY OF INVENTION

Desired objectives may be achieved through practice of the present invention, embodiments of which include a support cradle for holding a spool containing a multiplicity of wires, mounted on a support frame by bearing means which permit the cradle to remain positionally stable while a closure die and an associated frame spin with the frame rotating about the cradle, the cradle or its associated spool being replaceable in the machine as a unit.

DESCRIPTION OF DRAWINGS

This invention may be understood from the description which follows, and from the appended drawings in which FIG. 3 is a perspective view of the front portion of the embodiment of this invention shown in FIGS. 1 and 2, FIG. 4 is a perspective view of the guide plated-forming cone-closure die assembly useful with embodiments of this invention, FIG. 5 is an exploded perspective view of the drive shaft-closure die assembly useful with embodiments of this invention, FIG. 6 is an exploded perspective view of a closure plate assembly useful with embodiments of this invention.

DESCRIPTION OF PREFERRED EMBODIMENTS

Figure 1:
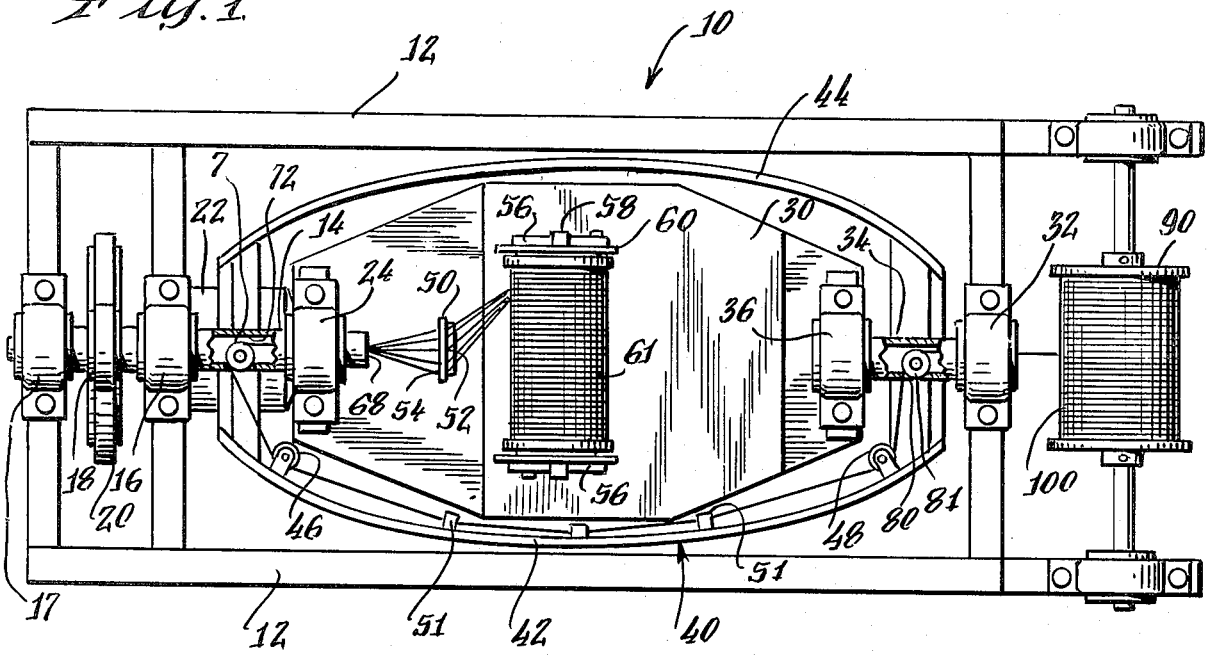
FIG. 1 is a top plan view of an embodiment of this invention.

Referring first to FIG. 1, there is depicted an embodiment of the present invention in the form of a 7-wire concentric stranding machine 10. It will be clear from what follows that although the principles of this invention are particularly well-adapted for use in producing 7-wire stranded material, they are applicable to other strand configurations as well, particularly of the so-called "concentric" type, such as 19 wire strands (1-6-12). The embodiment shown in FIG. 1 includes a support frame 12 to which a drive shaft 14 is rotatably affixed by means of bearing blocks 16, 17. To the outer end of the shaft 14 is affixed a pulley 18 which may be rotated by a belt 20 driven by a motor 22. About the inner-most end of the shaft 14 is rotatably affixed a cradle bearing 24, preferably of the split bearing type, so-called, to facilitate replacement of the cradle 30 as hereinafter described; the outer casing of the lower portion of the bearing 24 being affixed to one end of the cradle 30. There is a similar arrangement at the opposite end of the machine where a shaft bearing 32 supports a cradle shaft 34, from the innermost end of which the cradle 30 is moveably supported by means of a cradle bearing 36, also preferably of the split bearing type to facilitate replacement of the cradle 30. Drive means, caparable to the combination of pulley 18, belt 20, and motor 22 previously described, need not be included at this end of the machine, because as will be apparent from what follows, the single drive means normally will suffice to operate the machine, although optionally such a second drive means might also be included if desired.

Figure 7:
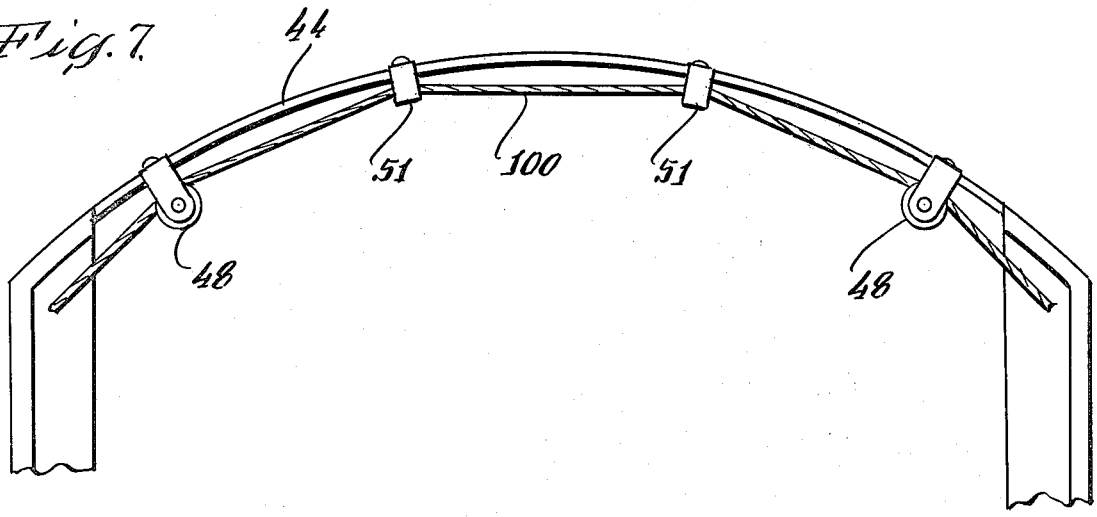
FIG. 7 illustrates a finished strand guide assembly useful with embodiments of this invention.
Figure 8:
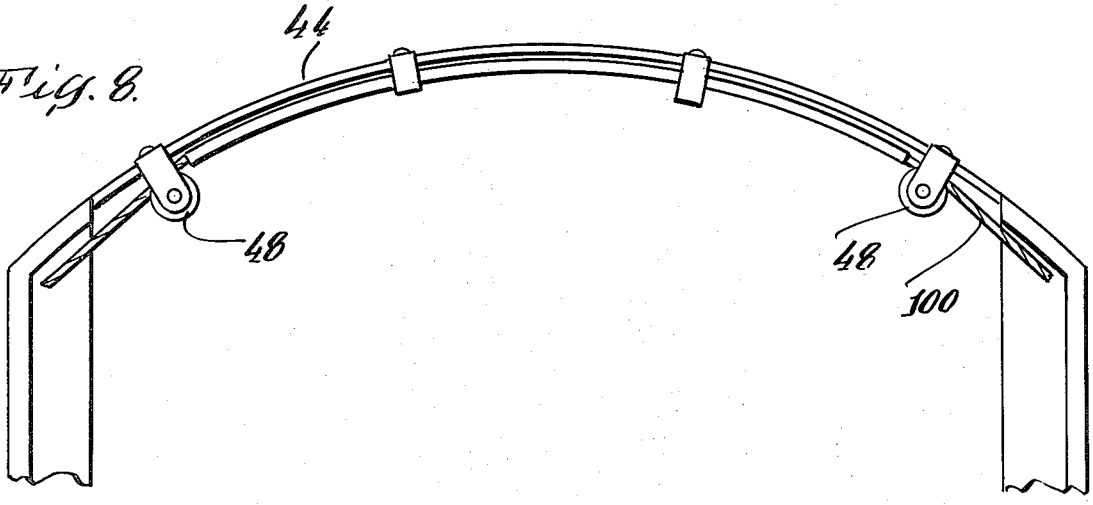
FIG. 8 illustrates another finished strand guide assembly useful with embodiments of this invention.

Affixed to the shafts 14, 34, intermediate the locations along their lengths at which are positioned respectively the bearings 24 and 32, is a spinning frame or bow 40, consisting of at least one, or (optionally) two, generally U-shaped arms 42, 44. It will be apparent that a single arm arrangement, wherein the arm carries the guide means hereinafter described, will suffice, particularly having in mind the reduced length of the machine overall and the other size and weight reductions which may be achieved through the practice of this invention as compared to the prior art. However, there may be instances where the counterbalancing effect of the second arm may be necessary or desirable, for purposes such as reduction of vibration, etc. It will also be apparent that because it is possible to make the spool-holding portion of embodiments of this invention shorter than the prior art devices while accomodating comparable total weights and numbers of ends of wires to those possible in such prior art devices, the bow 40 may be comprised of one (or two) more nearly semi-circular arms 42 (and 44). This geometry affords much greater inherent strength and stability against vibration, without the corresponding weight of the prior art devices. One of the arms 42 has pulleys 46, 48 and eyelets or guides 51 to serve as guides for wire coming from the machine. These elements are shown in greater detail in FIG. 7. FIG. 8 illustrates an alternate arrangement wherein the strand 100 is carried along the arm 44 by thinwalled plastic or metal tubing 47, which is held in place by tube holders 49. Because of the rigid affixation of the frame arms 42, 44, of the frame 40 to the shafts 14, 34, and the generally U-shaped configuration of the frame arms 42, 44, with the depth of the upright portions of each "U" greater than the width of the cradle 30, as the shaft 14 is driven by the motor 22 via the belt 20 and the pulley 18, the frame 40 will be caused to rotate about the cradle 30. The latter, being mounted to the ends of the shafts 14, 34 by means of the bearings 24, 36, will remain positionally stable without rotating along with the frame 40. It will also be noted that since the direction of frame rotation is a function of the direction in which the motor 22 turns, it is possible simply to reverse the direction of lay of the finished strand merely by reversing the motor.

Toward the front end of the cradle 30, in an adjustment slot **50*a*, there may optionally be affixed a guide plate 50. As shown in greater detail in FIGS. 2, 3, and 4, the closure plate 50 includes, in the form illustrated for use in producing a 7-wire strand, a central hole 52, and six evenly spaced peripheral holes 54. Affixed along the top of the cradle 30 is a spool support 56, having a shaft 58 to rotatably support an associated spool of wire. Optionally, the spool support 56 may be fitted with friction brakes 60 to ensure that a spool mounted thereon does not run so freely as to permit the wires to become slack and entangle. The spool support, as shown in this particular configuration, is arrayed so that the spool can pay off and feed its wire through the guide plate 50 and into the center hole 52**.

Figure 13:
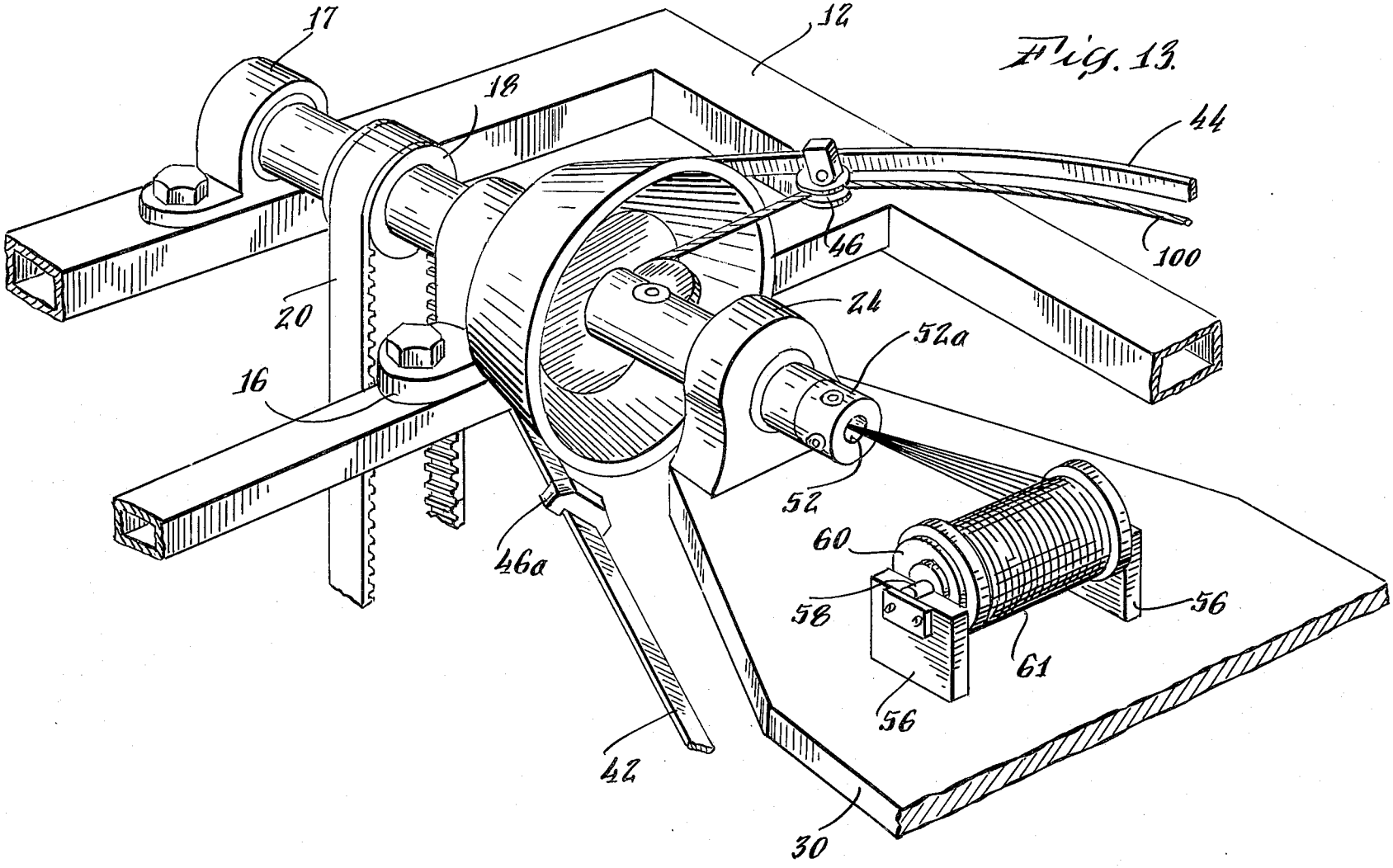
FIG. 13 illustrates a preferred embodiment of this invention.

It is to be understood that a feature of the present invention is that the use of a guide plate of the type described above is optional and need not be used at all. Thus, as shown in greater detail in FIG. 13, a multiplicity of wires which have been parallel-wound on a spool 61 may be brought directly into the forming die 52 without first having passed through the holes of a wire guide. Since the wires are close to each other as they come off the spool, they may be effectively formed into a smooth, uniform strand without the necessity of the more exact positioning which such a plate would provide. Further, with this embodiment, any number of wires may be stranded together without concern as to the exact number of holes available in an associated guide. In addition, the wires being so grouped and handled throughout collectively as a bundle, much less attention has to be paid to such things as fouling or increased dragloads which would have the tendency to break the wires if they were presented to it individually. At the same time, and as an associated phenomenon, this arrangement obviates the necessity of adjusting and monitoring within prescribed limits the tension on the wires individually induced by the spools themselves.

Figure 2:
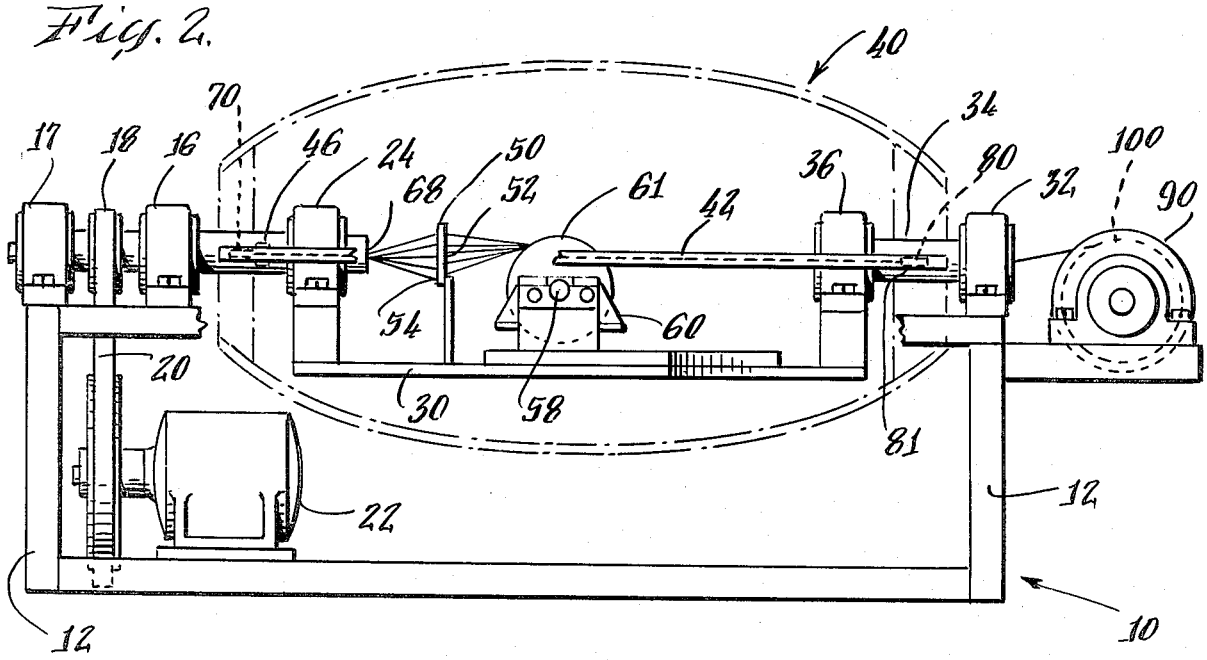
FIG. 2 is a side elevation view of the embodiment of this invention.

In operation, a spool containing a multiplicity of wires wound parallel thereon is mounted on the cradle 30 as shown in FIGS. 1 and 2, with each of the wires from the spool fed through one of the holes in the guide plate 50 if one is used; six through the peripheral holes 54 and one through the central hole 52. By this means it is assured that six peripheral wires will overlay a central wire in abutting relationship to each other, and substantially entirely overlaying the core wire, in the proper geometric configuration for a true concentric 7-wire strand. Alternative strand configurations (e.g., a 19-wire concentric strand) would utilize corresponding changes in the hole configuration of the closure plate, and/or might be adapted for each hole to accomodate a multiplicity of wires in each. Thus, for example, although 7-wire strands (6 over 1), 19-wire strands (12 over 6 over 1) and 37-wire strands (18 over 12 over 6 over 1) are traditional "true-concentric" configurations, as to which a separate guide-plate hole may be used for each wire, a 49-wire (7×7) "rope" might utilize 7 guide plate holes, each accomodating a 7wire concentric strand where seven such 7-wire strands have been wound in parallel on the spool, or, as noted above and illustrated in FIG. 13, in a preferred embodiment the use of a guide plate 50 may be eliminated entirely.

The center of the shaft 14 has an axial passageway 72 which preferably may be capped at the closure plate end by a forming die 68 which serves the purposes of monitoring the overall diameter of the finished strand. At the other end of the passageway 72 a pulley 70 projects through the side of the shaft 14. This arrangement of elements is shown in greater detail in FIG. 3, and in FIG. 5 which illustrates a means by which the closure die 68 may be removeably affixed to the cradle end of the shaft 14. Optionally, as shown in FIG. 4, where a guide plate is used, there may be positioned between the guide plate 50 and the closure die 68 a forming cone 62 at the closure die end of which is a carbide ring 64 to provide a contact surface for the constituent wires of the strand. The forming cone 62 may be affixed to the guide plate 50 by means of a nut and bolt assembly 67, by operation of which the cone can be adjusted positionally with respect to the closure die 68, so as to better monitor and control the positioning of the strand wires as the strand is being made. Further, as shown in FIG. 6, the guide plate when utilized may optionally be made in the form of a base plate 50*a*, with a threaded core member 53 surrounding the central hole 52, over which a supplementary piece 50*b* of the base plate may be positioned and secured by means of a nut 55. It should be noted that there are slots 54*a* associated with each of the holes 54 in plate 50*a*, and slots 54*b* associated with each of the holes 54 in the supplementary piece 50*b*, and that the slots 54*a* will not be congruent with the slots 54*b* when the plate 50*a* and supplementary plate 50*b* are juxtaposed. It should also be noted that the slot 52*a* associated with hole 52 will be covered in the region of the threaded member 53 when the nut 55 is in place. Thus, by this means, it is possible to insert replacement wires through the plate 50 without having to thread them through the plate holes, with assurance that they will not thereafter move out of the holes.

Figure 9:
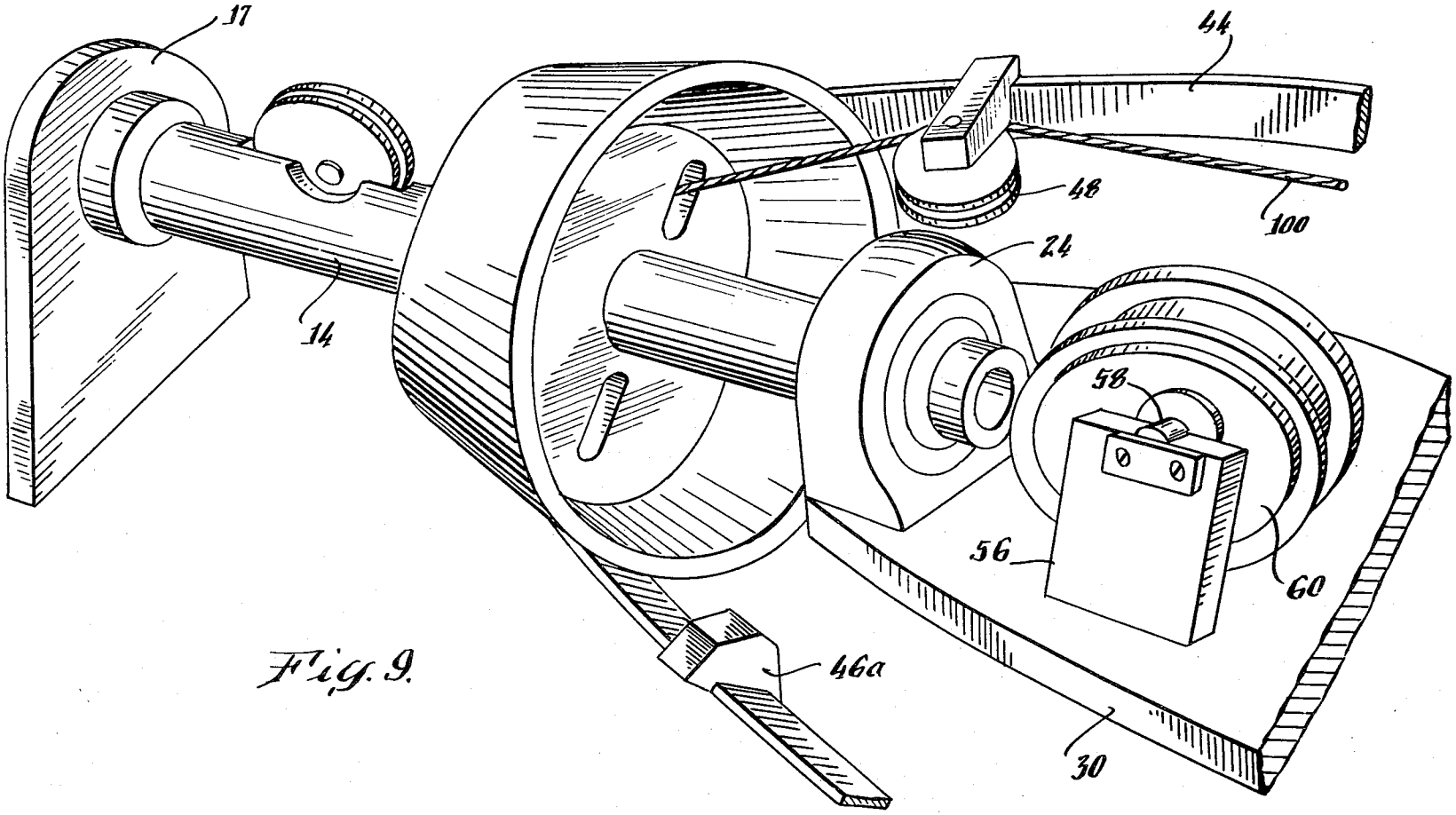
FIG. 9 is a perspective view of the rear portion of the embodiment of this invention shown in FIGS. 1 and 2.

In operation, the seven ends of wire coming from the spool may, as previously noted, be passed through the holes of the guide plate 50 if one is used, or if none is used as a group of parallel wires, to form a loose strand 100. The strand so formed may then be passed through the closure die 68 into the passageway 74, over the pulled 70, over the pulley 46, through the eyelets 51 or tube 47 (as the case may be), and over the pulley 48. Then, as is shown in greater detail in FIG. 9, as well as in FIGS. 1 and 2, the wires may pass into a side hole 80 over a pulley 81 in the shaft 34, through a central axial passageway (not shown) in the shaft 34 and straight out through its outer end onto a take-up reel 90. The latter, according to known per se techniques, may be synchronized so as to take up the finished wire evenly as it comes off of the machine. Thus, as the frame 40 is powered by the motor 22 and caused to revolve about the spool cradle 30 with the latter staying relatively stable, (i.e., not revolving), the wires are caused to be twisted into a true concentric strand 100 and, having been so twisted, to be given a final twist just before being delivered to the take-up reel 90.

Upon all or any one of the constituent wires breaking or being exhausted, the machine may be stopped automatically by known per se automatic stop means, or manually. If the cradle is of the type illustrated in FIG. 10, the individual broken wire may be brazed and/or re-threaded. Preferably, however, the spool may be replaced and its respective wires brazed for continuity to its predecessors and/or re-threaded, without brazing for continuity. Alternatively, replacement may be effected by removing the entire spool cradle 30, as by removal of the top half of the bearings 24, 36 when they are of the known per se split bearing type, permitting the entire cradle 30 to be removed as a unit and replaced by another similar entire unit which includes a full spool. FIG. 11 illustrates alternative apparatus which may be utilized to achieve the last-mentioned type of change-over without the necessity of having or opening split bearings as noted. In this embodiment, the cradle 30 has associated supplementary cradles 30*a* to which the spool supports 56 and forming plate assembly 50 are affixed. Each such supplementary cradle 30*a* may be affixed to a cradle 30 through operation of threaded studs 200 and associated wing nuts 202 as illustrated. Thus, by this means also the wires from the spool may be connected to the rear ends of the previous set of wires, albeit temporarily, as by merely tying them together, merely to facilitate pulling them through, or by permanently bonding them, end to end, as by soldering, as is known per se. With such "unit changeover" features, distinct advantages are realized. For example, the frequency of machine stoppages may be greatly enhanced through practice of these embodiments of this invention because servicing of the spools and/or wires can take place away from the machine itself, and without the machine being stopped while it takes place.

Figure 10:
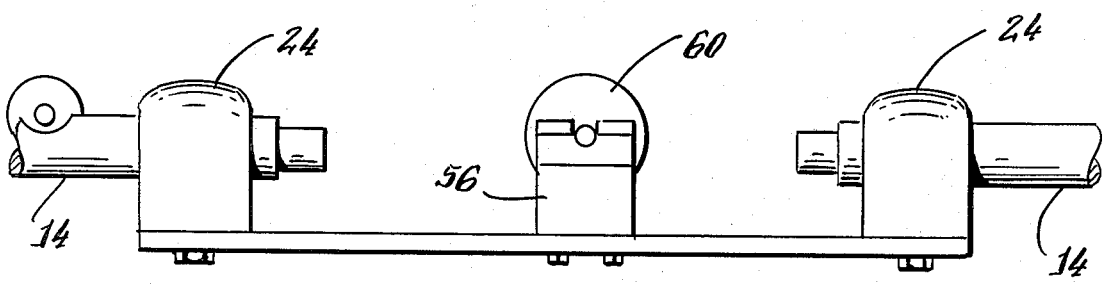
FIG. 10 is a side view of a spool mounting bed assembly useful with embodiments of the present invention.
Figure 11:
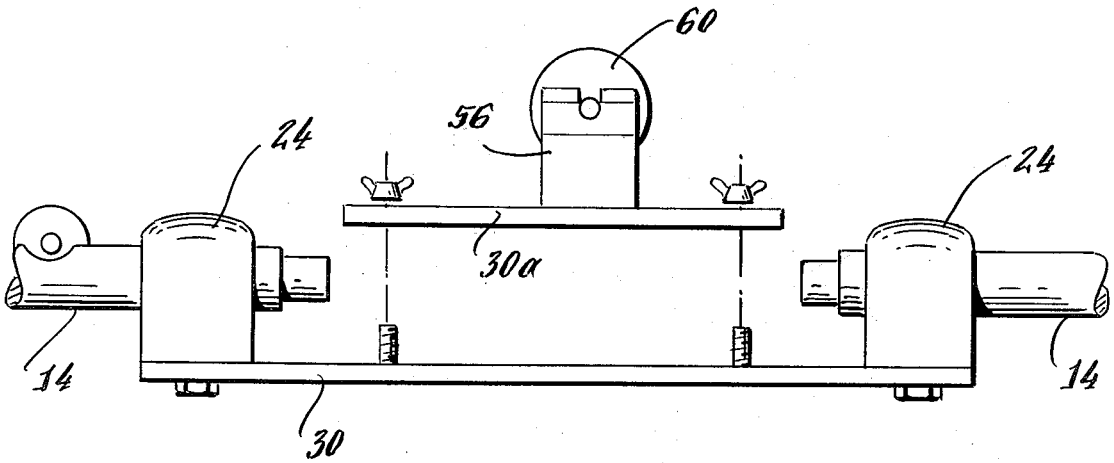
FIG. 11 is a side view of another spool mounting bed assembly useful with embodiments of the present invention.

It will be apparent that in practicing this invention in the manufacture of any strand, but 7-wire strand particularly, or 19-wire strand, or other such configurations not involving the stranding of previously stranded continuums, the unitized replacement feature of structures as shown in FIGS. 10 and 11 is not necessary, since replacement can occur by changing only a single spool, but such unitized structures are particularly useful where (e.g., a 49-wire rope) such strands of strands are to be made.

Figure 12:
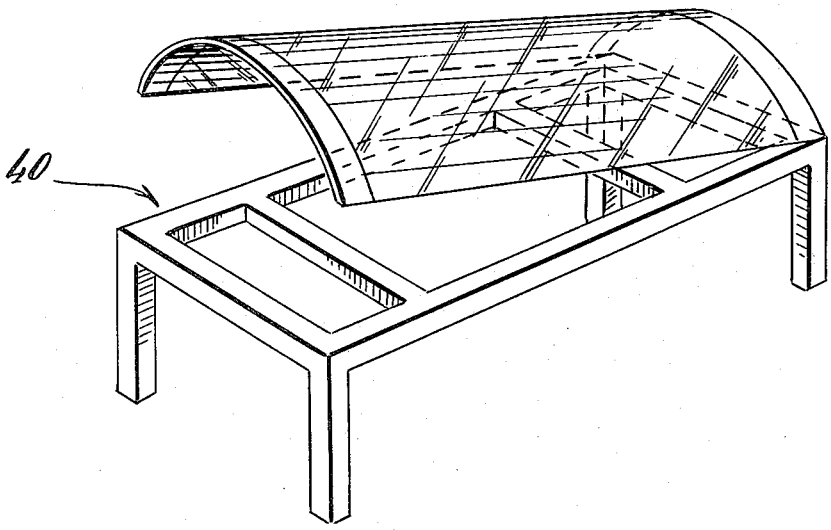
FIG. 12 is a perspective view of a hood assembly useful with embodiments of this invention.

FIG. 12 illustrates how embodiments of this invention may also include a cover, such as a dome 300 of expanded metal or plexiglass as illustrated, for purposes of noise reduction, safety, and reduction of contamination.

It will be understood from the foregoing that embodiments made in accordance with the present invention make it possible to achieve advantages over prior art apparatus for producing stranded wire which, as previously noted, include stranders of the "buncher" and the "barrel" type. With the former, individual wires from spools outside the machine are twisted and are gathered on an interior take up spool. This configuration makes it impossible to check the strand being produced without stopping the machine. A barrel strander, on the other hand, permits such monitoring to take place without stopping the machine, but because the spools of constituent single-end wire are arrayed linearly along the axis of the barrel and must be held substantially stationary while the barrel turns in order to create the desired twist, the spools must be bearing mounted with respect to the barrel. The resulting weight added to the barrel makes it heavy and susceptible to the high dynamic forces, limiting its speed and further necessitating weight being added to the barrel. Additionally, with embodiments of the present invention, it is possible to strand filaments utilizing equipment which is smaller in overall dimensions, utilizes small and lighter components, is less prone to vibration, may be produced cheaper, may be operated at higher speeds with reduced inertial effects, and may be operated with less "downtime" than prior art devices, including those made in accordance with the teachings of U.S. Pat. No. 4,302,924. Thus, through practice of the present invention, it is possible to monitor work product continuously while, at the same time realizing the advantages of low weight, high speed, structurally simple stranding apparatus.

It is to be understood that the embodiments of this invention herein disclosed and illustrated, are by way of illustration, and not of limitation, and that this invention may be carried out in a wide variety of embodiments without departing from the spirit or scope of this invention.

I claim:

1. Apparatus for stranding wire comprising a support frame, a first shaft bearing means affixed to one end of said frame, and a second shaft bearing means affixed to the end of said frame opposite that at which said first shaft bearing means is located, separate shafts rotatably positioned in each of said shaft bearing means, said shafts being coaxial with each other and including strand passage means, spool cradle support bearing means which is rotatably affixed to the innermost ends of each of said shafts, a spool cradle means, including spool support means, adapted for rotatably supporting a single spool for containing a multiplicity of continuous filaments wound parallel thereon, with the axis of said spool normal to the axes of said shafts and substantially bisected by an imaginery flat plane that is normal to both said axis of said spool and the axes of said shafts, said cradle being moveably affixed at each of its ends to one of said spool cradle support bearing means, a twisting frame having at least one arm, each end of which is affixed to one of said shafts between said frame and said cradle, which arm includes strand guide means and is so dimensional and configured as to pass between said frame and said cradle as it moves upon rotation of said shafts, and finished strand take-up means, whereby a multiplicity of parallel filaments may be caused to pass concurrently from a spool supported by said spool support into the strand passage means of the one of said shafts and, as said frame rotates while said cradle remains unrotating, be twisted into a strand, passed along said guide means from one end to the other end of said arm, passed through the strand passage means in the other of said shafts, further twisted, and taken up through operation of said take-up means.

2. The apparatus described in claim 1 including guide plate means affixed to said spool cradle for guiding said filaments into a positionally desired spaced-apart configuration after leaving said spool and before entering into said strand passage means.

3. The apparatus described in either of claims 1 or 2 wherein each of said arms is substantially semi-circular in shape.

4. The apparatus described in either of claims 1 or 2 wherein said spool cradle means is removeably affixed to said shaft bearing means.

* * * * *